US010034492B2

(12) United States Patent
McClure

(10) Patent No.: US 10,034,492 B2
(45) Date of Patent: Jul. 31, 2018

(54) HAND ROLLED CIGARETTE HOLDER

(71) Applicant: Anthony Mark McClure, Longbeach, CA (US)

(72) Inventor: Anthony Mark McClure, Longbeach, CA (US)

( * ) Notice: Subject to any disclaimer, the term of this patent is extended or adjusted under 35 U.S.C. 154(b) by 0 days.

(21) Appl. No.: 14/711,721

(22) Filed: May 13, 2015

(65) Prior Publication Data

US 2015/0327594 A1 Nov. 19, 2015

Related U.S. Application Data

(60) Provisional application No. 61/992,358, filed on May 13, 2014.

(51) Int. Cl.
*A24F 13/00* (2006.01)
*A24F 13/02* (2006.01)

(52) U.S. Cl.
CPC ..... *A24F 13/02* (2013.01)

(58) Field of Classification Search
None
See application file for complete search history.

(56) References Cited

U.S. PATENT DOCUMENTS 2,314,393 A * 3/1943 Dougherty ..... A24F 47/00 131/247
2,768,630 A * 10/1956 Johnson ..... A24F 13/14 131/175
2013/0047998 A1* 2/2013 Gollobin ..... A24F 13/08 131/328

* cited by examiner

*Primary Examiner* — Alison L Hindenlang
*Assistant Examiner* — Jamel M Nelson
(74) *Attorney, Agent, or Firm* — Will Hunziker

(57) ABSTRACT

A cigarette holder for filter-less or hand rolled cigarettes that comprises a hollow tube with a flange extending from its end and at least one spring which presses directly or indirectly against the proximate side of the flange. The spring is compressed and the flanged tube is inserted into the end of a cigarette. The spring is then released and it extends to secure the paper from the cigarette around the outside of the tube and against the flange. The cigarette is then held firmly in place such that it extends away from both the fingers and the lips with the cigarette holder's tube is in its interior.

4 Claims, 3 Drawing Sheets

HAND ROLLED CIGARETTE HOLDER

CROSS-REFERENCE TO RELATED APPLICATIONS

This document is a non-provisional patent application claiming the benefit of, and priority to, the following applications: U.S. Provisional Patent Application Ser. No. 61/992,358, entitled "Hand Rolled Cigarette Holder", filed on May 13, 2014; all of which is hereby incorporated by reference in it's entirety.

BACKGROUND OF THE INVENTION

1. Field of the Invention

The present invention relates to cigarette holders; and in particular, to hand rolled cigarette holders.

2. Description of Related Art

The vast majority of cigarettes that are smoked are mass-produced. Most smokers do not bother with a holder and will continue to smoke the cigarette until the tobacco is consumed and only the filter is left. Then the smoker will discard the cigarette stub.

Smokers who roll their own cigarettes usually do not have a filter. If they do not use a holder they will grab the hand rolled cigarette with their fingers until the cigarette is too short to hold any longer. The smoker will then discard what remains. Often some of the tobacco still remains in the stub and is wasted when it is discarded.

The popularity of hand rolled cigarettes is increasing. This is increasingly true since recent laws have permitted the smoking of marijuana for medical or recreational reasons in many states. Many smokers prefer to roll their own tobacco and marijuana cigarettes, which usually do not include filters.

It is common for marijuana smokers to use a clip or something to hold the butts of a marijuana cigarette to enable them to smoke it without burning themselves. These clips, or small pliers, are typically called roach clips and work by creating a distance between the smoker's hands and the heat of the cigarette; however, they do not protect the smoker's lips from getting burned. For tobacco smokers there are cigarette holders that hold the cigarette by encompassing the whole of the butt of the cigarette. These holders do not work well for cigarettes without filters because the ends of the cigarette are rarely regular and are usually tapered, which leads to the cigarette not being held firmly in the holder, rendering them useless.

What is needed is a cigarette holder for hand rolled cigarettes, filter-less cigarettes, or marijuana cigarettes (joints) that secures the cigarette firmly and extends it away from both the fingers and the lips.

SUMMARY

The scope of the present invention is defined solely by the appended claims and detailed description of a preferred embodiment, and is not affected to any degree by the statements within this summary. In addressing many of the problems experienced in the related art, such as those relating to securing a hand rolled cigarette to a holder and extending it away from the fingers and lips, the present disclosure generally involves a hand rolled or filter-less cigarette holder that comprises a hollow tube with a flange extending from its end and at least one spring which presses directly or indirectly against the proximate side of the flange. The spring is compressed and the flanged tube is inserted into the end of a filter-less cigarette. The spring is then released and it extends to secure the paper from the cigarette around the outside of the tube and against the flange. The cigarette is then held firmly in place such that it extends away from both the fingers and the lips with the cigarette holder's tube in its interior.

BRIEF DESCRIPTION OF THE DRAWINGS

The above, and other, aspects, features, and advantages of several embodiments of the present disclosure will be more apparent from the following Detailed Description as presented in conjunction with the following several figures of the Drawing.

1. Figures

Figure 1:
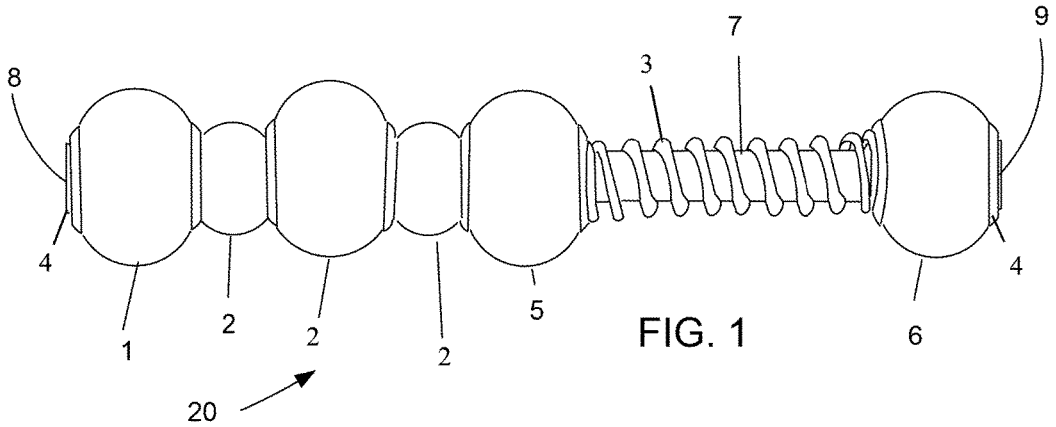
FIG. 1 (Sheet 1) illustrates a side view of a cigarette holder, in accordance with an embodiment of the present disclosure.

Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiment are often not depicted in order to facilitate a less obstructed view of these various embodiments of the present disclosure.

DETAILED DESCRIPTION

The following description is not to be taken in a limiting sense, but is made merely for the purpose of describing the general principles of exemplary embodiments, many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

Further, the described features, structures, or characteristics of the present disclosure may be combined in any suitable manner in one or more embodiments. In the Detailed Description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well-known structures, materials, or operations are not shown or described in detail to avoid obscuring aspects of the present disclosure. Any alterations and further modifications in the illustrated devices, and such further application of the principles of the invention as illustrated herein are contemplated as would normally occur to one skilled in the art to which the invention relates.

Unless otherwise indicated, the drawings are intended to be read (e.g., arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" mean positioned or supported on but not necessarily in direct contact with the surface.

The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The terms "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

For the purposes of promoting an understanding of the principles of the present invention, reference will now be made to the embodiments illustrated in the drawings and specific language will be used to describe the same.

FIGS. 1, 2, 3, 4, and 5 show the same preferred embodiment of a hand rolled or filter-less cigarette holder 20. Marijuana cigarettes are often called joints, this product holds joints as well and they are simply referred to as "cigarettes" in this description and the following claims. This embodiment comprises a hollow tube 7 capable of being smoked through which is made of any suitable material. Metal is preferred because it is resistant to heat and fire, but other materials with those properties may work just as well. The hollow tube 7 has a first distal end 8, and a second distal end 9. The hollow tube 7 has at least one flange 4. The one or more flanges 4 extend peripherally from the hollow tube 7. In one embodiment, there is a flange 4 at one or both of the distal ends 8 or 9 of the hollow tube 7.

This embodiment also comprises at least one spring 3. The at least one spring 3 is located outside and around the hollow tube 7. The spring 3 is kept in a state of compression such that it presses directly or indirectly against the proximate side of at least one peripherally projecting flange 4, and preferably against two flanges 4 on either end of the tube 7. A helical spring 3 wrapped around the hollow tube 7 works very well in this capacity.

In this embodiment the ideal length of the hollow tube 7 is longer than the spring 3, which is set along and over the hollow tube 7 between one or two flanges 4 on either distal end 8 or 9 of the hollow tube 7 with the compression of the spring 3 being created by objects placed between the flanges 4 and the spring 3. In this preferred embodiment, said intermediary objects may be beads 2. There may be one end bead 6 next to a flange 4 on a second distal end 9 of a hollow tube 7 that is also next to a spring 3, then the spring 3 itself, another intermediary bead 5, possibly more beads 2, and then an end bead 1 next to the second a first distal end 8 of the hollow tube 7. In this arrangement a smoker could hold the end of the tube with more beads, and the side with only one bead could be conveniently used to hold a cigarette. Beads are ideal objects for use between the flanges because they are hollow, slide easily, and are decorative; however any suitable object, or none, could be used.

Figure 2:
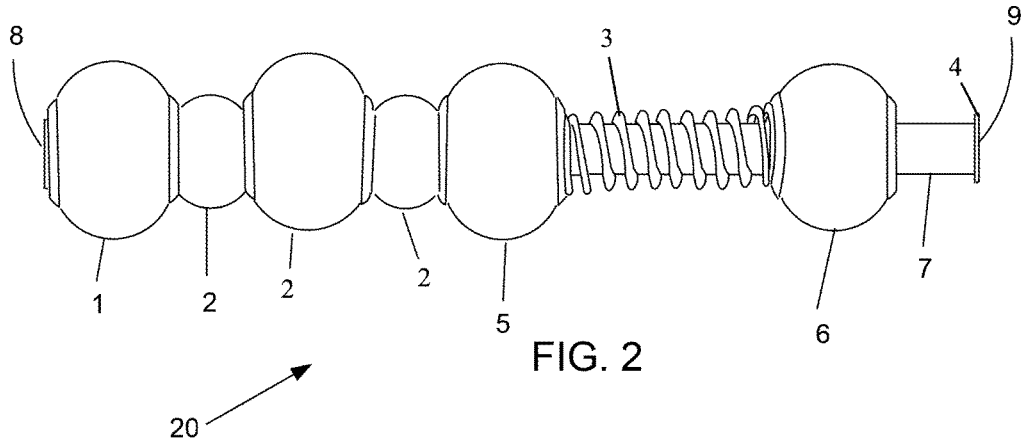
FIG. 2 (Sheet 1) illustrates a side view of cigarette holder with a spring compressed on the right, in accordance with an embodiment of the present disclosure.
Figure 3:
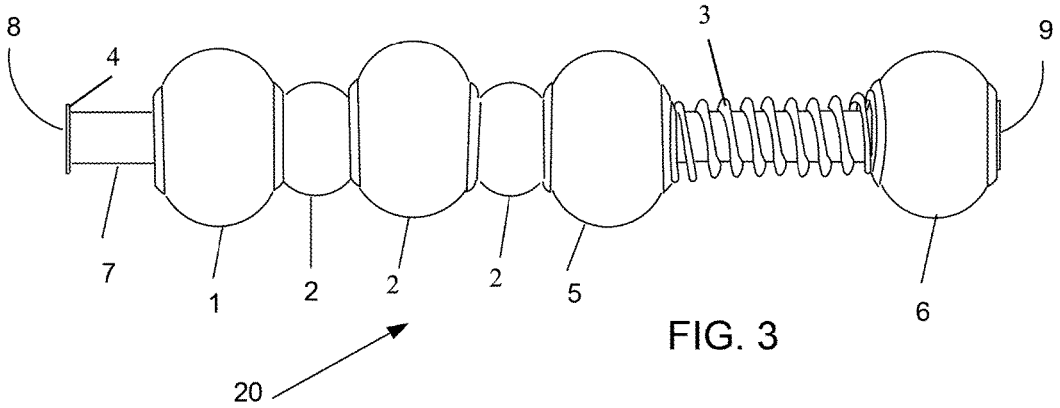
FIG. 3 (Sheet 1) illustrates a side view of cigarette holder with a spring compressed on the left, in accordance with an embodiment of the present disclosure.

As seen in FIGS. 2 and 3, this preferred arrangement allows the user to use either end of the cigarette holder if they prefer one side or the other. FIG. 2 shows the beads pushed away from the flange 4 on the second distal end 9 of the hollow tube 7, while FIG. 3 shows the beads pushed away from the flange 4 on the first distal end 8 of the hollow tube 7.

Figure 4:
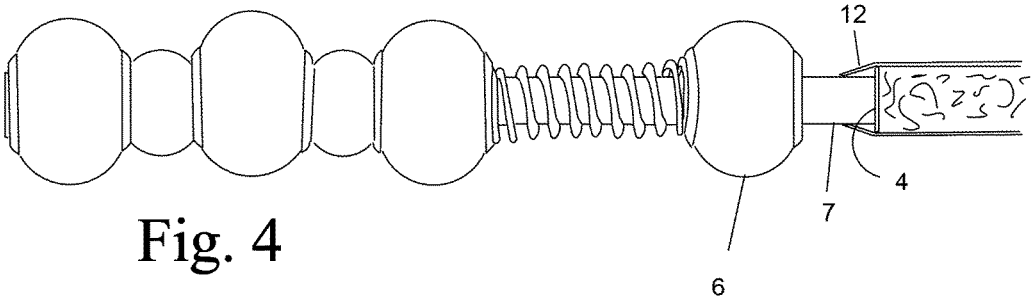
FIG. 4 (Sheet 2) illustrates a side view of cigarette holder with a spring compressed on the right with its tube placed inside of a cigarette, in accordance with an embodiment of the present disclosure.
Figure 5:
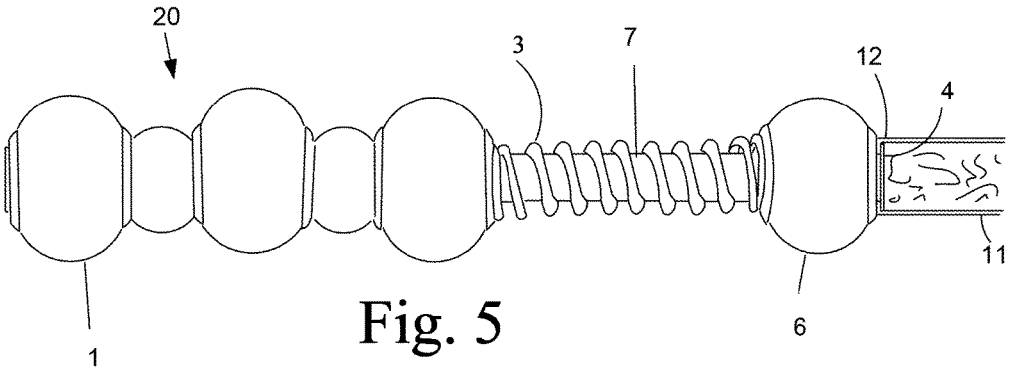
FIG. 5 (Sheet 2) illustrates a side view of cigarette holder with its tube placed inside of a cigarette, in accordance with an embodiment of the present disclosure.

FIGS. 4 and 5 show the operation of the device. FIG. 4 shows the second distal end 9 of the cigarette holder and its flange 4 being revealed by pulling on the bead closest to that end 6 and then being inserted inside the paper on the end of a cigarette 12. The paper can be pressed down around the back of the flange. FIG. 5 shows the cigarette holder 20 with the pressure which further compressed the spring released and the bead 6 closest to the flange 4 on the second distal end 9 of the hollow tube 7 firmly holding the cigarette 11 by its paper 12 in a circular fashion against the proximal side of the flange 4 and the hollow tube 7 thereby sealing the paper around the hollow tube 7 and allowing the smoker to securely smoke the cigarette through the hollow tube 7 without burning their hands or lips, and without the leakage of smoke. It is important that the spring or indirect object have a gap sufficient for the paper of the cigarette to fit between the bead, spring, or other object, and the hollow tube 7.

Figure 6:
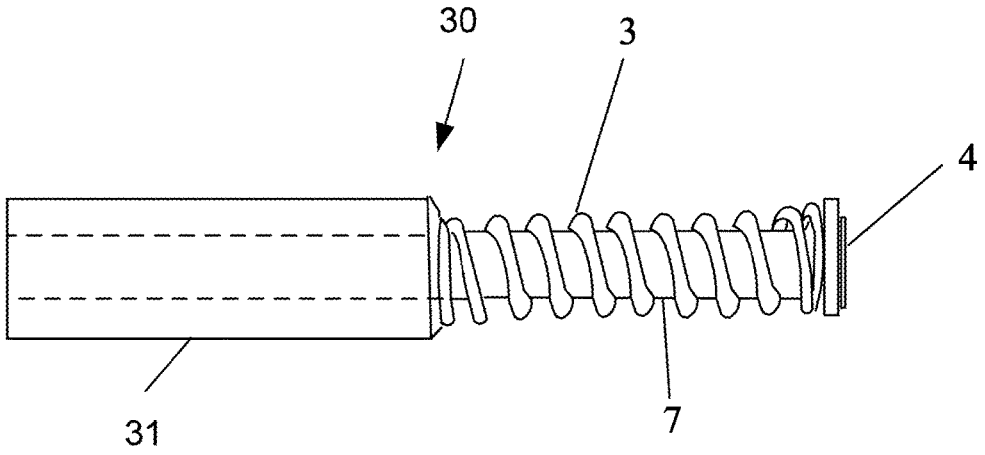
FIG. 6 (Sheet 3) illustrates a side view of a cigarette holder, in accordance with an embodiment of the present disclosure.
Figure 7:
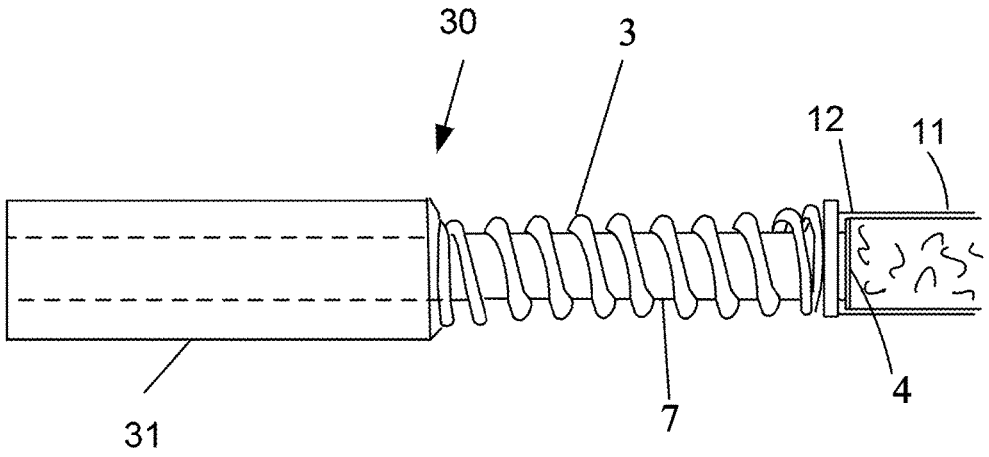
FIG. 7 (Sheet 3) illustrates a side view of cigarette holder with its tube placed inside of a cigarette, in accordance with an embodiment of the present disclosure.

Other preferred embodiments are possible. For example, FIG. 6 shows a simpler and less decorative embodiment of a cigarette holder 30. In this embodiment there are no beads and only one flange 4. The spring 3 is compressed between the flange 4 and a wider region of a hollow tube 31. FIG. 7 shows the embodiment of FIG. 6 in use, the operation is the same as with the embodiment using beads above.

Information as herein shown and described in detail is fully capable of attaining the above-described object of the present disclosure, the presently preferred embodiment of the present disclosure; and is, thus, representative of the subject matter; which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims.

However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

What is claimed is:

1. A cigarette holder, comprising:

a hollow tube capable of being smoked through either distal end, wherein said hollow tube has flanges located at either distal end and wherein said hollow tube and said flanges are small enough to fit inside either end of a cigarette;

a spring, wherein said spring fits outside of said hollow tube and is in a state of compression, wherein said spring compression presses directly or indirectly against the spring-facing side of said flanges and is capable of securely holding the paper at one of the ends of a said cigarette directly or indirectly against said spring-facing side of said flange on either end of said hollow tube while said cigarette is smoked through said hollow tube without leakage of the smoke.

2. The cigarette holder of claim 1, wherein the spring presses directly against said spring-facing side of said flange.

3. The cigarette holder of claim 1, wherein the spring presses indirectly against said spring-facing side of said flange by an intermediary object.

4. The cigarette holder of claim 3, wherein the intermediary object is one or more beads.

* * * * *